US005399820A

United States Patent [19]

Silfvast

[11] Patent Number: 5,399,820

[45] Date of Patent: Mar. 21, 1995

[54] LIGHTED PUSHBUTTON PANEL SWITCHES

[75] Inventor: Scott W. Silfvast, LaHonda, Calif.

[73] Assignee: Euphonix, Inc., Palo Alto, Calif.

[21] Appl. No.: 80,951

[22] Filed: Jun. 21, 1993

[51] Int. Cl.[6] ..... H01H 9/18

[52] U.S. Cl. ..... 200/314; 200/345

[58] Field of Search ..... 200/54, 292, 310, 313, 200/314, 329, 341, 344, 345, 315

[56] References Cited

U.S. PATENT DOCUMENTS

| | | | |
|---|---|---|---|
| 3,691,985 | 9/1972 | Otterlei | 200/314 X |
| 4,056,701 | 11/1977 | Weber | 200/314 |
| 4,163,138 | 7/1979 | Harden | 200/310 |
| 4,449,024 | 5/1984 | Stracener | 200/310 X |
| 5,280,146 | 1/1994 | Inagaki et al. | 200/310 X |

*Primary Examiner*—Renee S. Luebke
*Attorney, Agent, or Firm*—Donald R. Boys

[57] ABSTRACT

A pushbutton assembly for panel arrays of pushbuttons has a pushbutton assembly comprising an LED extended through a guide bushing and connected to a first printed circuit board. The guide bushing is mounted to the first printed circuit board. A movable cover over the LED has pins extending through guide bores in the guide bushing with an actuator plate mounted to the pins on the opposite side of the first printed circuit board from the cover. A second printed circuit board spaced apart from the first has spring-loaded pushbutton switches mounted thereto, with the spacing such that pressing on the cover activates the pushbutton switch by means of the activator plate. The assembly of two boards may have any convenient array of switches assembled thereon, with the switch signals routed on one board and the driving signals for the LEDs routed on the other. The assembly of printed circuit boards is mounted with the covers protruding through a panel to present an array of lightable switch covers to an operator.

8 Claims, 10 Drawing Sheets

LIGHTED PUSHBUTTON PANEL SWITCHES

FIELD OF THE INVENTION

The present invention is in the area of lighted pushbutton input devices for control systems, and has particular application to audio mixing systems.

BACKGROUND OF THE INVENTION

Audio production for television, video, film, and recorded music sales is a large and growing enterprising, the foundation of much of the entertainment industry. Automation in the form of computerization is becoming more and more important as the basis of technical advances in this industry, to provide ability to mix and process more sophisticated and more voluminous audio input and to provide more flexibility in output. Computerization is also seen as a requirement for cost-effective competition. Manual instruments, systems, and techniques are, by comparison, increasingly more expensive to use.

The basic instrument of audio production is the production mixing console, a workstation presenting an interface to a sound engineer through which he or she may condition multiple channels of audio input, and mix the conditioned results into mono or stereo outputs for direct broadcast or for recording. A production mixing console, hereinafter a mixer, typically presents arrays of input devices, such as switches, knobs, and "faders", for an operator to set to condition and route audio signals. A fader is typically a slide rheostat through which an amplitude may be adjusted as a result of the linear position of the input lever relative to a track.

Mixers typically route audio input signals to individual channels, and each such channel has a repetitive layout of switches, knobs, and faders. For example, a single channel can have more than one input, such as a microphone input and an input from an instrument, a group of instruments, or a tape. Using the controls on a mixer an engineer can select microphone, line, and tape inputs, route the inputs to signal conditioning devices like faders and equalizers, and mix and route the output from the conditioning devices as well. There is typically a selective ability to monitor audio signals, such as by headphones, and often a microphone for talkback by the sound engineer operating the console.

Audio mixing, especially with digital techniques and computer control, is historically a rather recent development. When rock-and-roll music was first introduced there was no such device as a mixer. In the fifties, recording was done by direct input. Modern mixing was initiated about the time of the appearance of the Beatles, and the first units were highly individualistic. Through the sixties and early seventies direct audio mixers continued to be developed, and continued to be relatively small units with a few channels and were very unique in layout. In the mid-seventies standards began to appear, especially relative to layout of switches, rotary potentiometers, and faders. With a standard layout it became possible for a sound engineer to go from one studio to another, and take over the functions comfortably.

In the early development and well into the late seventies, mixers were completely manual. The audio signals were routed to the mixer, and directly through the switches, pots, and faders. In the 1980's automation began to appear in professional recording studios. With the continued development of automated audio mixing and the never-ending addition of new I/O features, the circuitry of consoles has become increasingly more complex. More switches, buttons, and dials mean crowded printed circuit boards. Contributing to the problem, the abundant use of pushbutton switches with light-emitting diodes (LED's) has doubled the density of printed circuit boards since separate circuits for the LED component and the signal component are required for each LED pushbutton installed.

A typical audio mixer console today may well have as many as several hundred LED pushbuttons, each having four leads. A large array of such pushbuttons pushes the density of circuitry to unmanageable proportions.

What is needed is means of separating signal circuitry for pushbuttons from the circuitry for lighting the LEDs in the pushbuttons. An arrangement allowing the circuits to be implemented on separate printed circuit boards would reduce the circuit density for each board and allow for expansion for future requirements. Also, the design and production of dense circuit boards is expensive. It would be more cost-effective to produce two simple boards than one complex one.

SUMMARY OF THE INVENTION

In a preferred embodiment of the invention a lighted pushbutton apparatus is provided comprising a first printed circuit board having electrically conductive traces for activating a lighting element in said pushbutton apparatus, bushing means mounted on the first printed circuit board for guiding movement to operate the pushbutton apparatus, a lighting element having its electrical leads connected to the electrically conductive traces on the first printed circuit board, and extending through an opening in the bushing means, a cover means for covering the lighting element and having pins extending through guide bores in the bushing means, providing for guided movement of the cover means relative to the first printed circuit board, a second printed circuit board spaced apart from the first printed circuit board and having a spring-loaded pushbutton switch connected thereto with an operating element facing the first printed circuit board, and cap means attachable to the pins on the opposite side of the first printed circuit board from the cover means for pressing on the operating element.

In an embodiment of the invention an array of pushbuttons is implemented on an assembly of two printed circuit boards, with all lighting signals routed on one of the boards, and all switch signals routed on the other. The assembly is mountable to a panel from inside with pushbutton covers presented through openings in the panel to provide an operator interface.

In another aspect of the invention, standard LED packages are altered to provide a flat instead of a rounded end extending under the cover, to diffuse the emitted light to light the cover area evenly.

The pushbutton assembly in the embodiments described herein provides a means for routing signals for lighting LEDs on one board and for routing the switch signals on another, simplifying both boards and minimizing the overall cost of the assembly.

DESCRIPTION OF THE PREFERRED EMBODIMENTS

Figure 1:
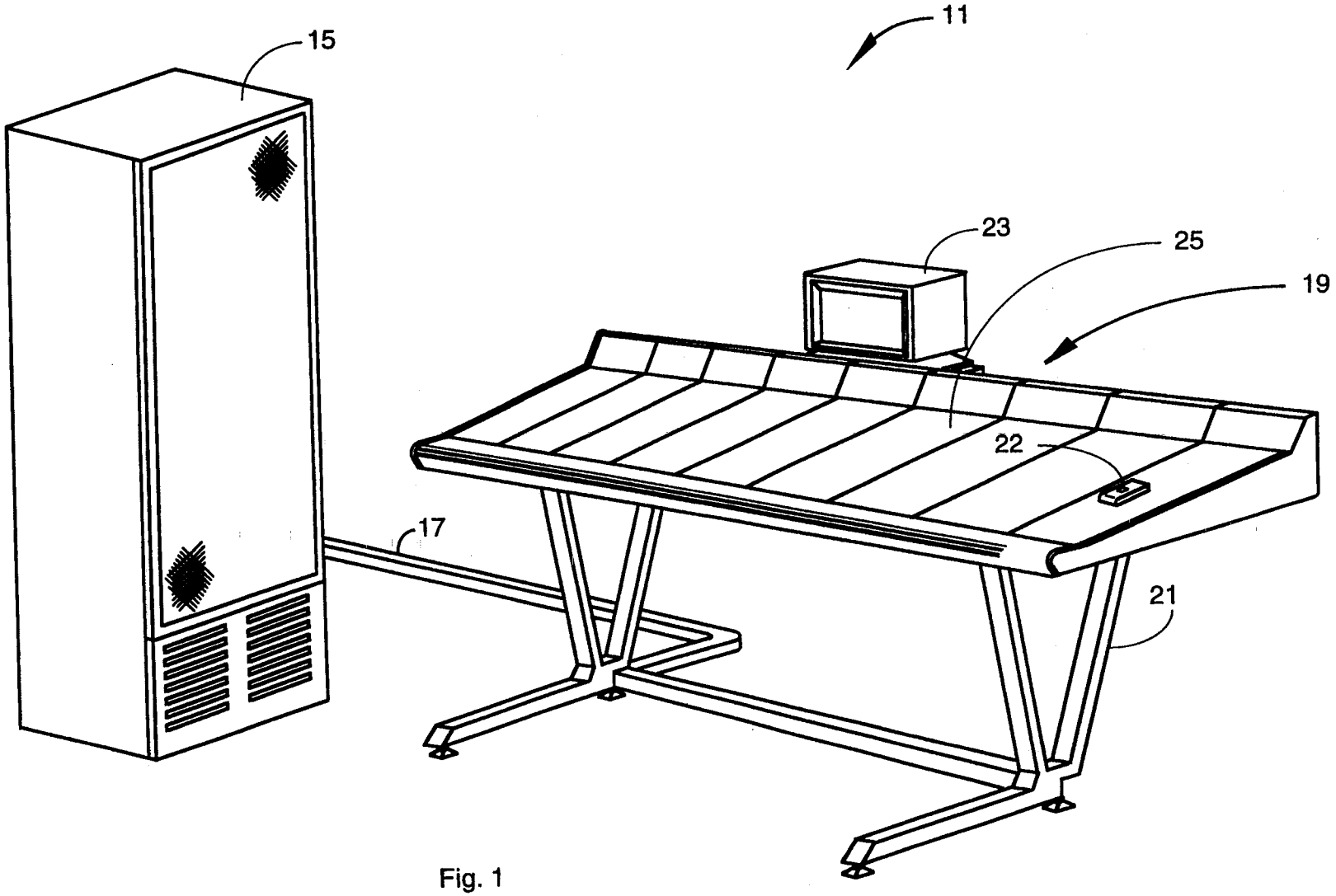
FIG. 1 is an isometric view of an audio mixing system according to an embodiment of the invention.

In a preferred embodiment the present invention is a method for layering circuit boards behind an input panel in conjunction with lighted pushbutton inputs to lessen the circuit density on the boards. FIG. 1 is an isometric view of an audio mixing system 11, wherein the functions are separated into a digital control console 19 and an audio tower 15.

Control console 19 comprises control hardware and computer components. There are no audio signals fed to, processed by, or routed from the control mainframe, other than talkback and headphone systems required for control communication. All audio signals are processed by and output from audio tower 15. This strict separation allows the audio mainframe to be located away from the control console, even in a separate room. Communication between control console 19 and the audio tower is provided through cables carried in a signal pathway 17 between the two in one of a number of possible layouts such as under the floor, overhead, and so forth.

Control console 19 is carried on a support frame 21, has computer elements not shown in FIG. 1, a display monitor 23, and a "mouse" pointer input device 22. Console 19 in this embodiment has eight removable modules. Seven of these are I/O modules each comprising four I/O control channels. The eighth module is the master control module.

Figure 2:
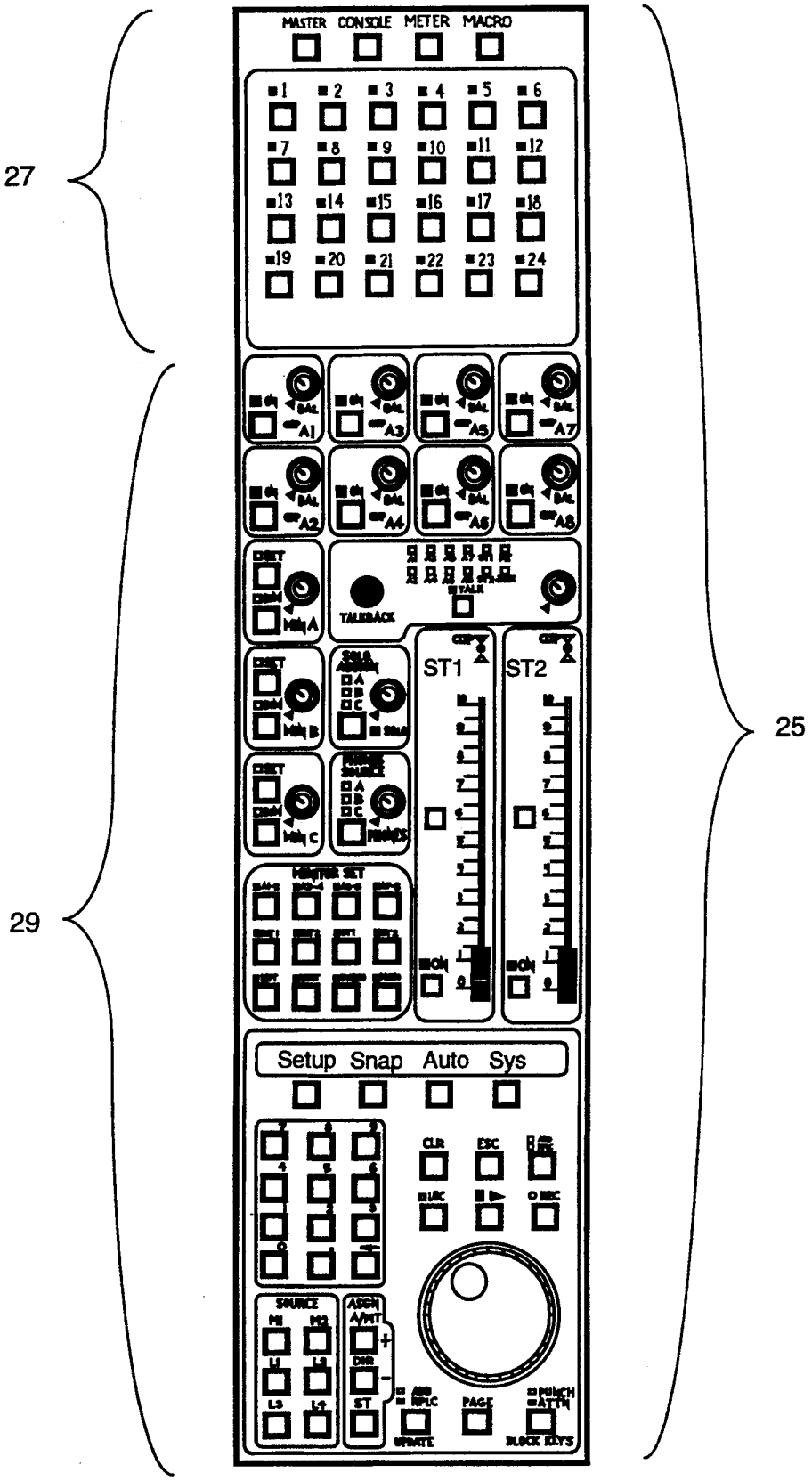
FIG. 2 is a plan view of an individual input module in the system of FIG. 1.

FIG. 2 shows the layout of input devices in master module 25. The top section of the master module contains an array of LED pushbuttons 27. See FIG. 3 for a magnified view of LED pushbutton array 27. Bottom section 29 of the master module in FIG. 2 contains an assortment of different input devices with switches, knobs, faders, and more pushbuttons. The inputs from each module provide digital signals to an on-board CPU in each module connected to an internal bus to a connector that allows the modules to be removed and interchanged.

The purpose of the present invention is to reduce the density of printed circuit boards required to implement LED pushbutton arrays on control panels. With a conventional LED, pushbutton signals go to LED driver and pushbutton switch circuits on the same circuit board. The practice of the present invention makes possible a layered approach to LED pushbutton circuitry, whereby the LEDs are driven by circuitry on one circuit board and the switch signals are routed on a separate circuit board. This two layer circuit board system for lighted pushbuttons doubles the amount of available board space, and reduces complexity and cost accordingly.

Figure 3:
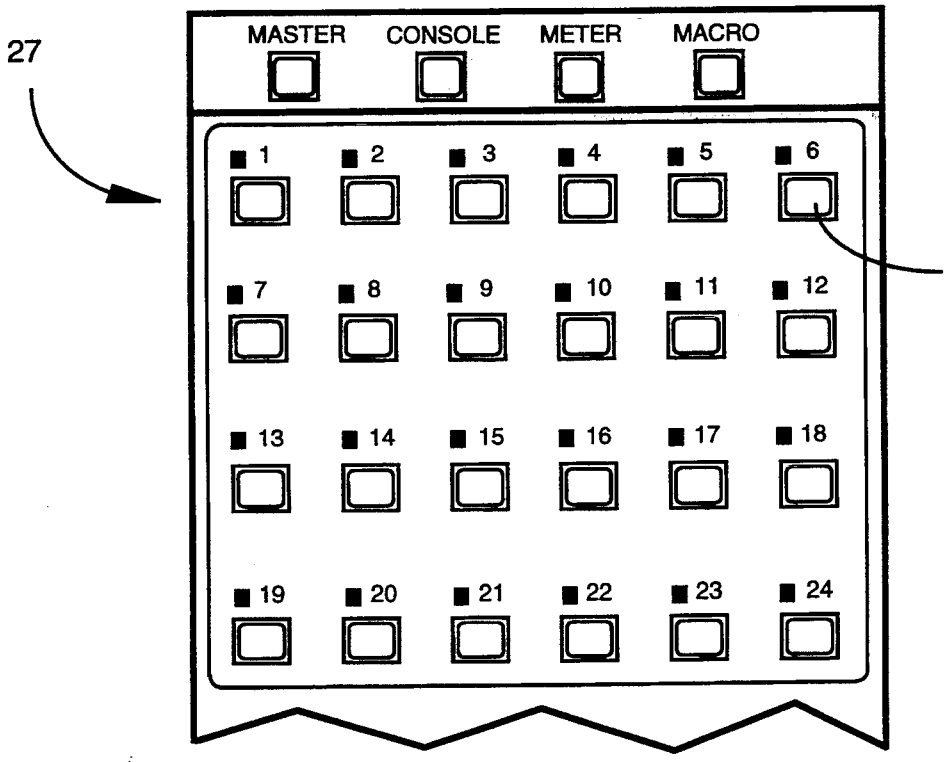
FIG. 3 is an enlargement of an array of LED pushbuttons shown in FIG. 2.
Figure 4:
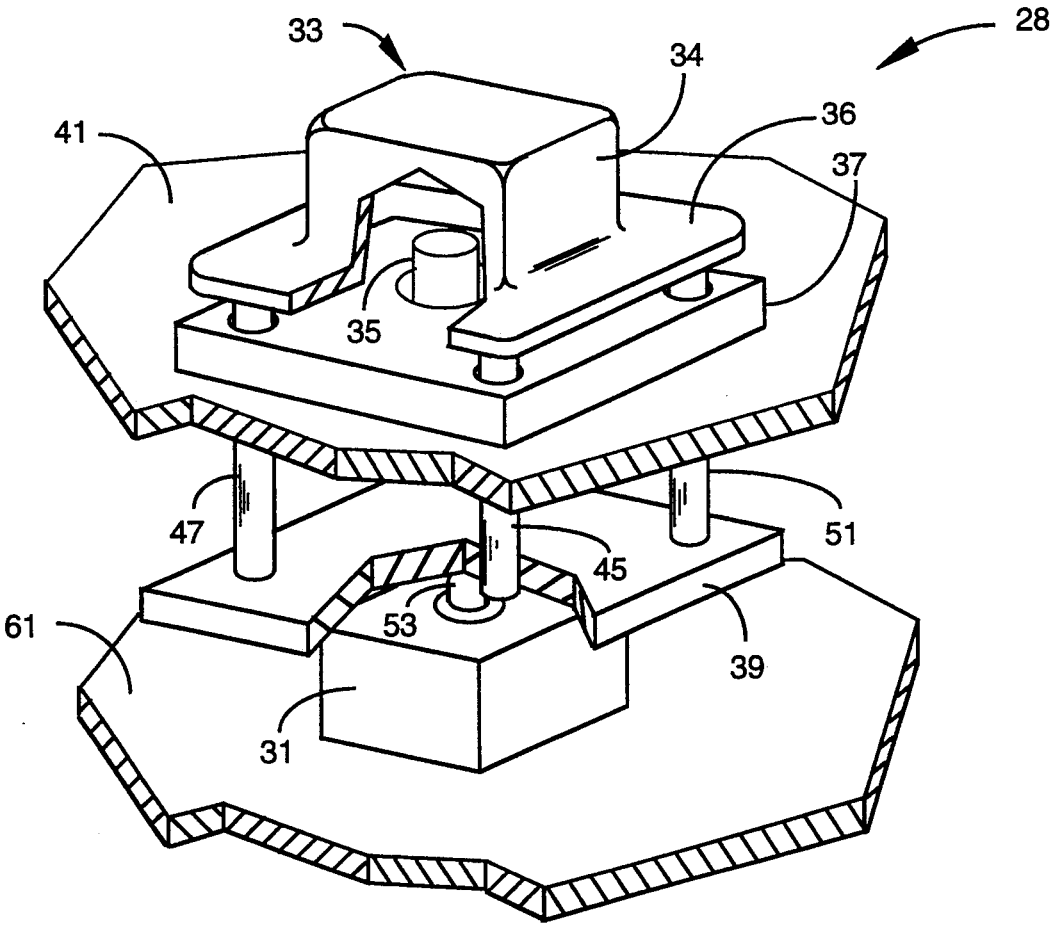
FIG. 4 is an isometric of an LED pushbutton unit assembled to printed circuit boards according to an embodiment of the invention.

FIG. 4 is an isometric view of a single LED-lighted pushbutton switch assembly 28 according to a preferred embodiment of the present invention, assembled to two printed circuit boards. This is one of an array of such pushbuttons, such as shown in FIG. 3.

In this embodiment there are four parts to the assembly in addition to the circuit boards: cap 33, LED 35, bushing 37, and actuator plate 39. Cap 33 has a translucent plastic top 34 extending from a flange 36. LED 35 is soldered to leads on printed circuit board 41, and extends through a hole in bushing 37 into the area under top 34.

Bushing 37 is attached to printed circuit board 41, and serves as a guide for movement of cap 33 in actuating the pushbutton. Cover 33 in this embodiment also has four pins 45, 47, 49, and 51 that extend from flange 36 vertically downward through guide bores in bushing 37, through clearance holes in circuit board 41, and snap into receptacle openings in actuator plate 39.

A conventional pushbutton switch 31 of the sort designed for and used on printed circuit boards for keyboards for computers is mounted on a second printed circuit board 61, which is spaced apart from printed circuit board 41 by an amount such that actuator plate 39 touches the spring-loaded activator post of the keyboard-type pushbutton switch. When an operator presses on cover 33 the cover is guided by bushing 37 and actuator plate 39 depresses switch 31 to make the switch contact.

Figure 5:
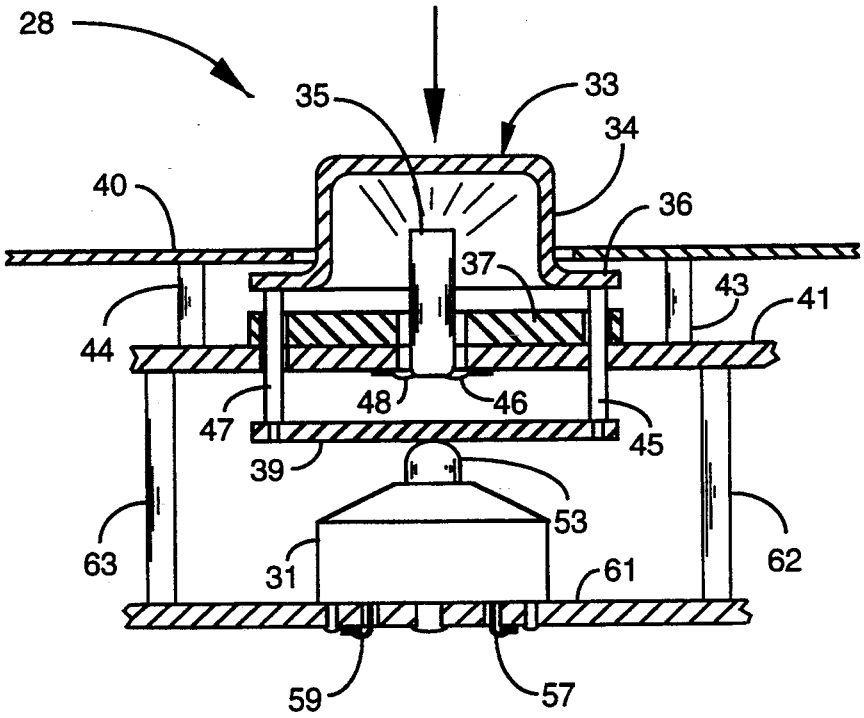
FIG. 5 is an elevation cross-sectional view of the pushbutton unit of FIG. 4.

FIG. 5 is an elevation cross-sectional view of the switch assembly according to the embodiment of FIG. 4. Spacers, such as spacers 43 and 44 shown, maintain space between front panel 40 and LED driver circuit board 41. LED 35, which is nested in an opening in bushing 37 and extends under cover 33, has two leads 46 and 48 that are soldered to traces on printed circuit board 41.

Cover 33 extends through an opening in panel 40, and the pins extending from flange 36 pass through guide bores in bushing 37 which is fixedly attached to printed circuit board 41. Pins 45 and 47 are shown in FIG. 5. The pins carry actuator plate 39 which urges against spring-loaded actuator post 53 of switch 31, which is assembled to printed circuit board 61, spaced apart from printed circuit board 41 by spacers, such as spacers 62 and 63 shown.

As described above, switch unit 31 is a standard type of switch device as used for keyboards, and in this particular embodiment is a unit manufactured by the Cherry Switch Company. Leads 57 and 59 are soldered to traces on printed circuit board 61.

In the embodiment described, switch units 31 are assembled to one printed circuit board 61 in a geometric array according to the array of the pushbuttons on the panel, and the switch leads are soldered to traces on that printed circuit board. LEDs are likewise soldered to a separate printed circuit board 41 laid out in the same geometric array as for printed circuit board 61, and bushings 37 are assembled to this board. Then covers 33 are assembled to the bushings, actuator plates 39 are assembled to the other side, and the two circuit boards are assembled parallel to one another with spacers between. The two board layered assembly is then assembled to panel 40 from the backside with covers 33 extending through openings in the panel, providing an array of lighted pushbuttons with the switch circuitry implemented on one printed circuit board (61) and the LED driver circuits implemented on another (41).

Figure 7A:
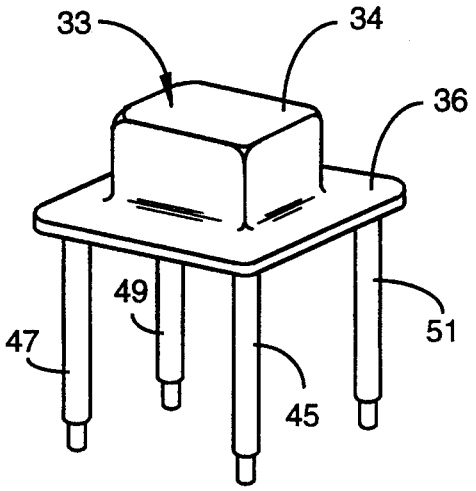
FIG. 7A is an isometric view of a cover section of the pushbutton in an embodiment of the invention.
Figure 7B:
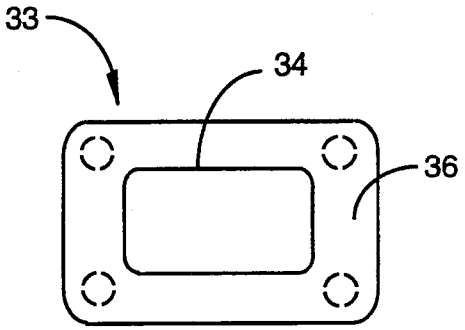
FIG. 7B is a top view of the cover section of FIG. 7A.
Figure 7C:
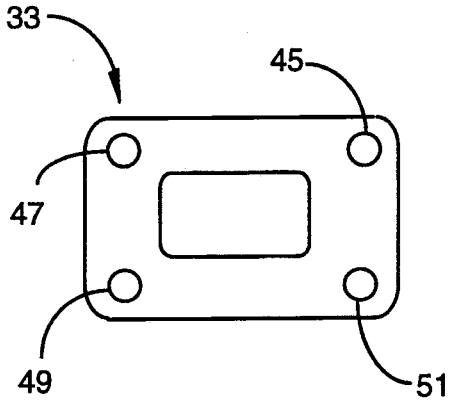
FIG. 7C is a bottom view of the cover section of FIG. 7A.

FIGS. 7A, 7B, and 7C, respectively, show isometric, top, and bottom views of LED cover 33 in the embodiment described above. Flange 36 has four pins 45, 47, 49, and 51 that extend from base 36.

Figure 8A:
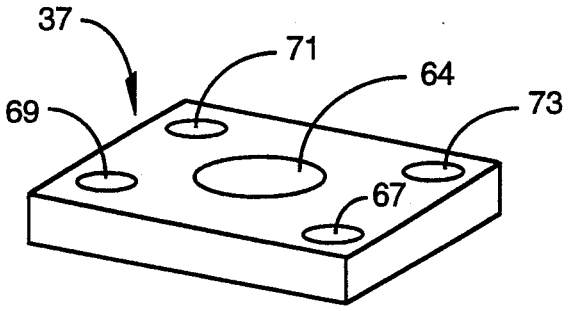
FIG. 8A is an isometric view of a bushing section in an embodiment of the invention.
Figure 8B:
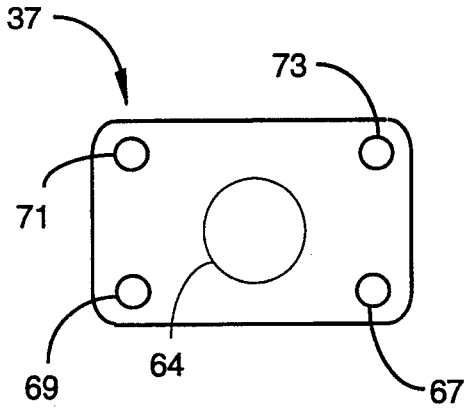
FIG. 8B is a top view of the bushing section of FIG. 8A.
Figure 8C:
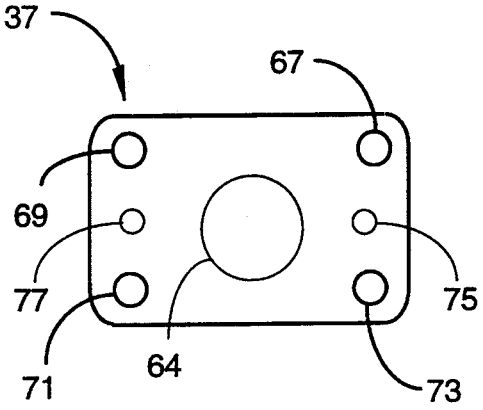
FIG. 8C is a bottom view of the bushing section of FIG. 8A.

Bushing 37 is shown in FIGS. 8A, 8B, and 8C as an isometric view, top view, and bottom view, respectively. Bushing 37 accommodates the LED device through a center opening 64. Four through holes 67, 69, 71, and 73 are for pins 45, 47, 49, and 51 from cover 33. As best seen in FIG. 8C, two short pins 75 and 77 are provided to position and hold the bushing in place on circuit board 41.

Figure 9A:
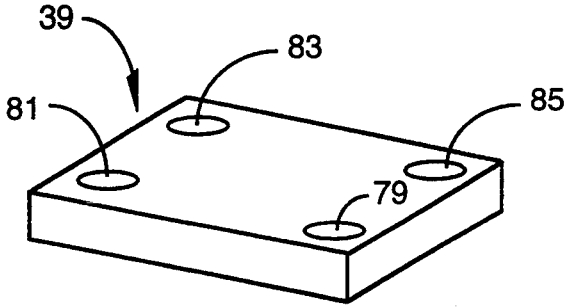
FIG. 9A is an isometric view of an actuator section in an embodiment of the invention.
Figure 9B:
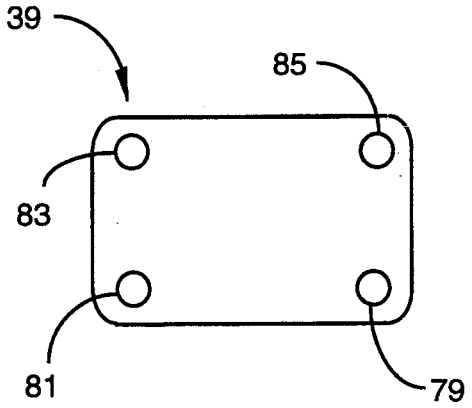
FIG. 9B is a top view of the actuator section of FIG. 9A.
Figure 9C:
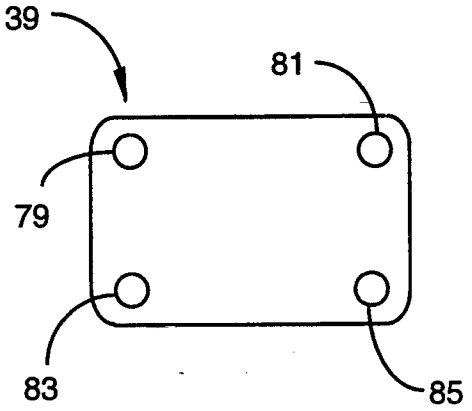
FIG. 9C is a bottom view of the actuator section of FIG. 9A.

Actuator plate 39 is shown in FIG. 9A as an isometric view, FIG. 9B as a top view, and FIG. 9C as a bottom view. Four openings 79, 81, 83, and 85 are for receiving cover pins 45, 47, 49, and 51. The bottom surface of actuator 39, as shown in FIG. 8C, is flat to interface with actuator post 53 of pushbutton switch 31 (FIG. 5).

Figure 10:
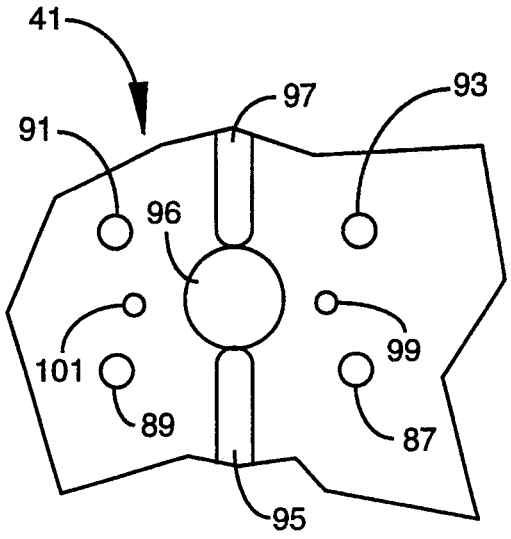
FIG. 10 is a plan view of a part of an LED driver printed circuit board in an embodiment of the invention.

FIG. 10 shows one position for an LED and bushing 37 on printed circuit board 41. Openings 87, 89, 91, and 93 accommodate pins 45, 47, 49, and 51 from cover 33 as shown in FIG. 4. Openings 99 and 101 are for position and fastening pins 77 and 75 of bushing 37 as shown in FIG. 8C. LED 35 extends through hole 96 through the printed circuit board, and solder pads 95 and 97 are for connection to leads 46 and 48 of LED 35 (FIG. 5).

Figure 11:
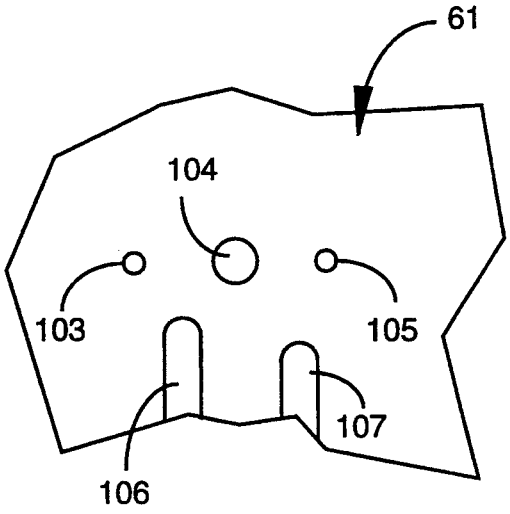
FIG. 11 is a plan view of a pushbutton signal printed circuit board in an embodiment of the invention.

FIG. 11 illustrates one position for mounting a switch 31 on printed circuit board 61. Openings 103, 104, and 105 position and mount the switch unit, and elements 106 and 107 are solder pads for the electrical leads of the switch device.

Figure 6A:
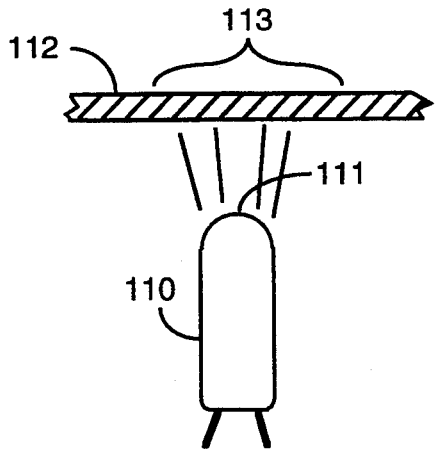
Fig. 6A (Prior Art)
FIG. 6A is an elevation view of a conventional LED demonstrating light emission pattern.

FIG. 6A shows a conventional LED 110 with a rounded top 111 and a portion of a cover 112. The rounded top has a focusing effect that tends to cause a bright spot in region 113 on cover 112.

Figure 6B:
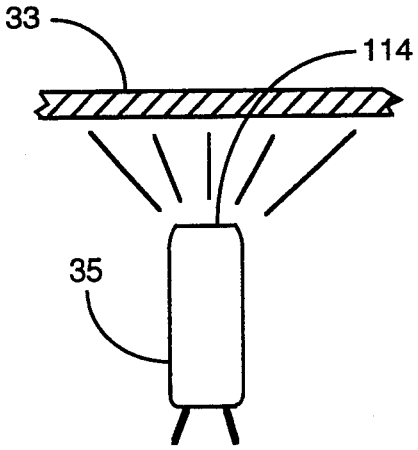
FIG. 6B is an elevation view of an LED according to an embodiment of the invention.

FIG. 6B shows an LED 35 with the upper end 114 ground flat. This flat-surfaced shape is a feature of an embodiment of the invention and diffuses the emitted light so the cover is more evenly lighted.

It will be apparent to one with skill in the art that there are many changes that might be made in the embodiment described without departing from the spirit and scope of the invention. There are, for example, other types of conventional pushbuttons that might be used for the signalling element other than the keyboard switch described above. There are likewise other geometries that would be useful for the through assembly of the moveable element to actuate the switch assembly on the second circuit board. There are alterations that might be made in materials, dimensions and more, and many other changes and alterations that might be made without departing from the spirit and scope of the invention.

What is claimed is:

1. A lightable pushbutton apparatus comprising:

a first printed circuit board having first electrically conductive traces adapted for activating a lighting element;

a bushing element mounted on said first printed circuit board, said bushing element having a central opening for said lighting element;

a translatable cover positioned over said bushing element and having at least one guide extension extending through a guide bore in said bushing element, providing for guided movement of said translatable cover relative to said first printed circuit board;

a second printed circuit board spaced apart from said first printed circuit board and having a spring-loaded switch connected to second conductive traces formed on said second printed circuit board; and an actuator attached to said at least one guide extension and positioned for operating said spring-loaded switch.

2. An array of lightable pushbuttons adapted for mounting to a control panel, comprising:

a first printed circuit board having first electrically conductive traces adapted for activating lighting elements;

an array of bushing elements mounted on said first printed circuit board, each of said bushing elements having a central opening for one of said lighting elements;

a translatable cover over each bushing element, each cover having at least one guide extension extending through a guide bore in one of said bushing elements, providing for guided movement of each said translatable cover;

a second printed circuit board spaced apart from said first printed circuit board and having an array of spring-loaded switches in a matching array to said array of bushing elements, said spring-loaded switches connected to second electrically conductive traces on said second printed circuit board; and actuators attached to each of said guide extensions and positioned for operating said spring-loaded switches.

3. An array of lightable pushbuttons as in claim 2 wherein each of said translatable covers comprises a translucent surface over each of said bushings elements.

4. An array of lightable pushbuttons as in claim 2 wherein said guide extensions comprise plural guide shafts from each translatable cover, engaging plural guide bores through said bushing elements, said guide bores arranged radially around said central opening.

5. A control panel having a front face with an array of openings therethrough and an assembly of lightable pushbuttons mounted thereto, said lightable pushbutton assembly comprising:

a first printed circuit board having first electrically conductive traces adapted for activating lighting elements;

an array of bushing elements mounted on said first printed circuit board, each of said bushing elements having a central opening for one of said lighting elements;

a translatable cover over each bushing element, each cover having at least one guide extension extending through a guide bore in a bushing element, providing for guided movement of each said translatable cover;

a second printed circuit board spaced apart from said first printed circuit board and having an array of spring-loaded switches in a matching array to said array of bushing elements, said spring-loaded switches connected to second electrically conductive traces on said second printed circuit board; and actuators attached to each of said guide extensions and positioned for operating said spring-loaded switches.

6. A control panel as in claim 5 wherein each of said translatable covers comprises a translucent surface over each of said bushings elements.

7. A control panel as in claim 5 wherein said guide extensions comprise plural guide shafts from each translatable cover, engaging plural guide bores through said bushing elements, said guide bores arranged radially around said central opening.

8. A method for separating electrical circuitry for a lighting element from electrical circuitry for switch contacts in a lightable pushbutton array, comprising the steps of:

forming first circuitry adapted for powering said lighting elements on a first printed circuit board;

forming second circuitry for sensing operation of said switch contacts on a second printed circuit board adapted for mounting spring-loaded switches thereto;

mounting a guide bushing to said first printed circuit board, said guide bushing having a central opening for said lighting element and at least one guide bore therethrough;

spacing said first and said second printed circuit boards apart and substantially parallel;

placing a translatable cover over said guide bushing, the translatable cover having a guide extension extending through said guide bore and terminating in an actuator positioned to operate said spring-loaded switch.

* * * * *